US005369940A

United States Patent [19]

Soloman

[11] Patent Number: 5,369,940

[45] Date of Patent: Dec. 6, 1994

[54] AUTOMATIC FILLING SYSTEM

[75] Inventor: Sabrie B. Soloman, Ridgewood, N.J.

[73] Assignee: Pfizer Inc, New York, N.Y.

[21] Appl. No.: 9,513

[22] Filed: Jan. 27, 1993

[51] Int. Cl.[5] ..... B65B 57/20

[52] U.S. Cl. ..... 53/501; 53/54; 53/500

[58] Field of Search ..... 53/500, 501, 244, 504, 53/54, 52

[56] References Cited

U.S. PATENT DOCUMENTS

| | | | |
|---|---|---|---|
| 2,523,517 | 9/1950 | Potter | 53/500 X |
| 2,760,315 | 8/1956 | Wilckens et al. | 53/501 |
| 3,133,624 | 5/1964 | Craig | 53/501 |
| 3,376,970 | 4/1968 | Roseberg | 53/501 X |
| 3,677,437 | 7/1972 | Haigler | 53/500 X |
| 3,837,139 | 9/1974 | Roseberg | 53/501 |
| 3,997,063 | 12/1976 | Adams et al. | 53/501 X |

*Primary Examiner*—James F. Coan
*Attorney, Agent, or Firm*—Peter C. Richardson; Paul H. Ginsburg; Grover F. Fuller, Jr.

[57] ABSTRACT

An automatic filling system which inserts objects into containers includes a feed hopper. A conveyor conveys a plurality of the objects into the feed hopper. The feed hopper has a discharge station. A collection station is located at the discharge station for disposing the containers in a position for receiving the objects fed from the discharge station. The feed hopper includes a flat inclined disc which receives the objects from the conveyor. The disc is rotated at a sufficiently high speed to cause the objects to move under centrifugal force toward the periphery of the disc. The feed hopper further includes a cylindrical member having an annular wall disposed around the disc and having an upper edge located generally at the same elevation as the upper end of the disc so that objects moving toward the periphery of the disc are moved to the upper edge of the cylindrical member and are conveyed on the upper edge away from the upper end of the disc. The discharge station is located at the upper edge of the cylindrical member for depositing the objects in the containers at the collection station. A counting device in the feed hopper counts the number of objects being deposited in each container for preventing excess objects from being deposited.

21 Claims, 5 Drawing Sheets

10
16
26
28
38
48
50
54
63
64
66
68
70
72
74
76
78
80
82
84

AUTOMATIC FILLING SYSTEM

BACKGROUND OF THE INVENTION

There is a need in various arts to provide an automatic filling station which is capable of depositing various objects into containers. An example is in the pharmaceutical industry where it is desired to deposit tablets or capsules into containers such as bottles. It would be desirable in such systems to be able to effectively fill the containers at a high rate of speed without sacrifice of precision in having a predetermined number of such objects in each container.

SUMMARY OF THE INVENTION

An object of this invention is to provide an automatic filling system which satisfies the above needs.

A further object of this invention is to provide such a filling system which is particularly capable of depositing pills in capsule or tablet form into containers, such as bottles.

A still further object of this invention is to provide such a system which is capable of operating automatically at a high rate of speed.

In accordance with this invention the automatic filling system includes conveying means for conveying a plurality of the objects into a feed hopper. The feed hopper has a discharge station for receiving the objects and depositing them into containers located at a collection station near the discharge station. In the preferred practice of this invention the feed hopper includes a flat inclined disc disposed for receiving the objects from the conveying means. Means are provided for rotating the flat inclined disc at a sufficient speed for causing the objects to move under centrifugal force toward the periphery of the disc. The feed hopper further includes a cylindrical member having an annular wall disposed around the disc and having an upper edge located at generally the same elevation as the upper end of the disc so that the objects moving toward the periphery of the disc are moved to the upper edge of the cylindrical member and are conveyed on the upper edge of the cylindrical member away from the upper end of the disc. The discharge station is located at the upper edge of the cylindrical member for depositing the articles in the containers at the collection station. A counter in the feed hopper counts the objects being deposited.

In the preferred practice of this invention the cylindrical member is also rotated at a different speed than the disc, but at a speed sufficient to facilitate conveying the objects away from the upper end of the disc.

The filling station may include delivery control means for assuring that the proper number of articles are deposited in each container. The delivery control means may include a pair of the counters, preferably laser counters, which count the objects being conveyed on the upper edge of the disc in a single line to assure that the proper number of objects pass through the discharge station for each container. A fixed guide wall is preferably disposed at the upper edge of the cylindrical member to help maintain the objects being in a single line as the objects move away from the upper end of the disc. An air jet may be provided to direct the objects against and into the discharge chute. A deflector may be provided to direct objects back into the feed hopper.

THE DRAWINGS

DETAILED DESCRIPTION

The present invention is intended to provide an automatic filling system for inserting objects into containers. The filling system may be used with respect to any type of discrete objects which are intended to be inserted into any type of container. In particular, the invention is intended to be used for disposing a predetermined number of objects into each of a plurality of containers. In the preferred practice of this invention, which will be described in detail, the filling station will be used for depositing tablets or capsules into containers, such as bottles or cartons, which is particularly useful in the pharmaceutical industry where a fixed number of tablets or capsules must be placed in each container. It is to be understood, however, that the invention is not necessarily limited to the pharmaceutical industry or to the filling of bottles or other containers with capsules/tablets.

Figure 1:
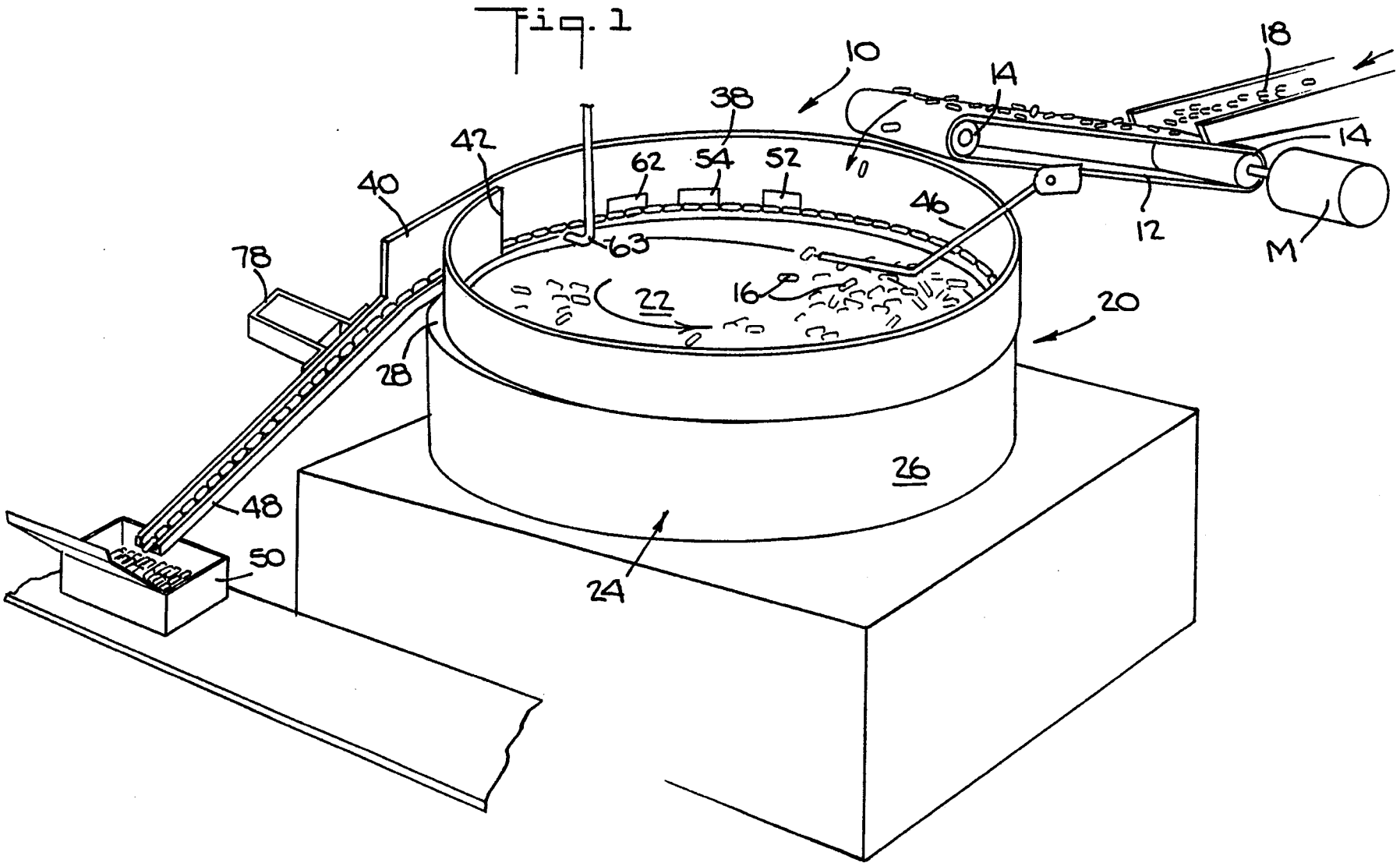
FIG. 1 is a perspective view of an automatic filling system in accordance with this invention.

FIGS. 1–6 illustrate an automatic filling system 10 in accordance with this invention. As shown therein and particularly with respect to FIGS. 1–3 the automatic filling system 10 includes conveying means 12 which may be of any suitable construction, such as an endless conveyor mounted on rollers 14 with one of the rollers being motor driven by motor M. As best shown in FIG. 1 the objects 16 which are preferably in the form of capsules/tablets are deposited on conveyor 12 in any suitable manner, such as by feed chute 18 which also may be a conveyor or which may be a static chute connected to some suitable form of capsule/tablet supply.

Conveyor 12 is located so that it extends directly above a feed hopper 20. Feed hopper 20 includes a flat inclined disc 22 and a cylindrical member 24 having an annular wall 26 which extends around and encloses disc 22. The upper end of inclined disc 22 is located generally at the upper edge 28 of cylindrical member 26.

Figure 3:
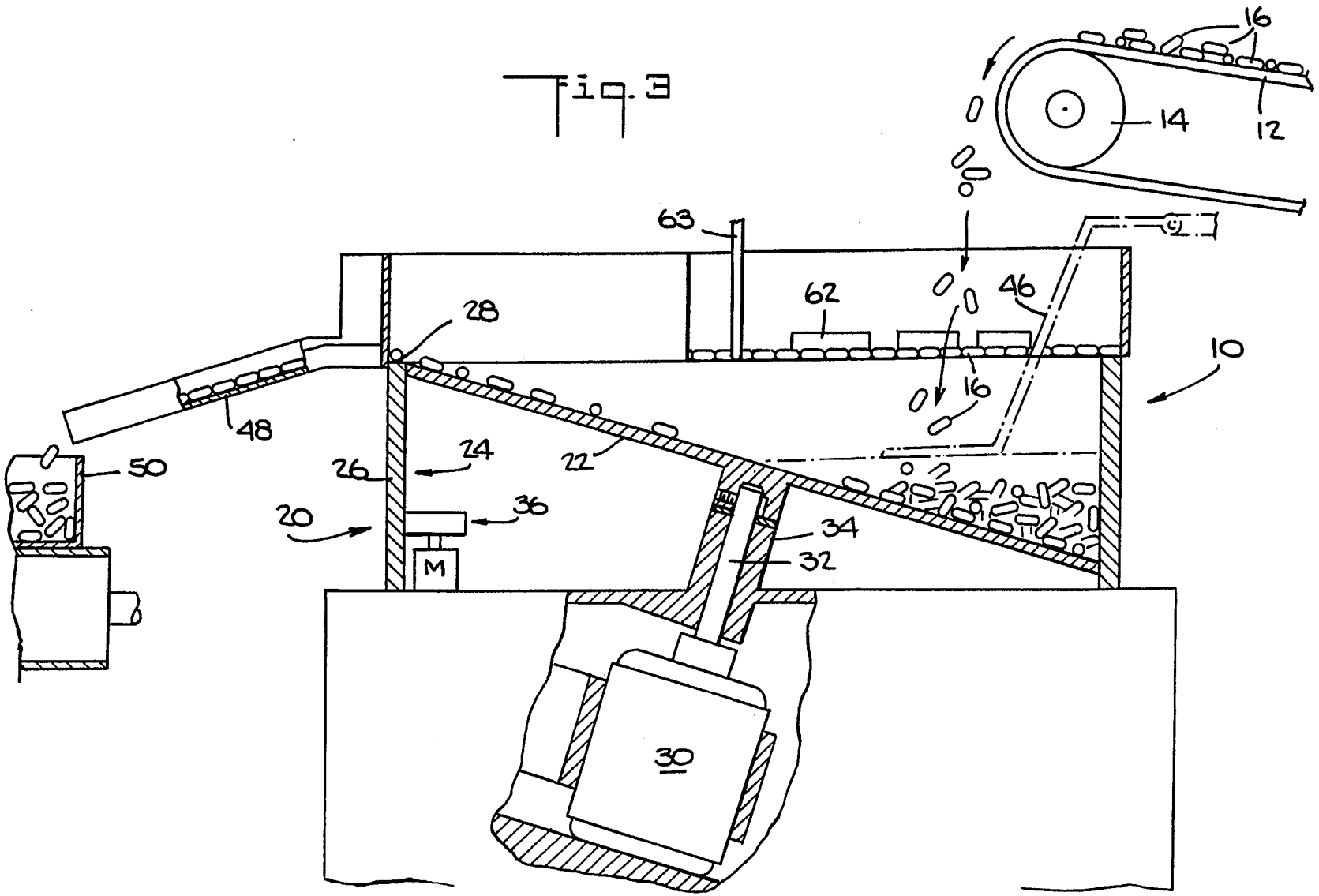
FIG. 3 is a cross-sectional view in elevation taken through FIG. 2 along the line 3—3.

As best shown in FIG. 3 disc 22 is connected to any suitable drive, such as motor 30 having a shaft 32 which is mounted to tubular extension 34 on the lower side of disc 22. Motor 30 is thereby capable of rotating disc 22.

In the preferred practice of this invention any suitable motor drive 36 is also connected to cylindrical member 24 for rotating cylindrical member 24. See FIG. 3. In practice disc 22 would be rotated at a sufficiently high speed to create a centrifugal force which causes the objects 16 to move toward the periphery of disc 22. Annular wall 26 of cylindrical member 24 maintains the objects 16 at the periphery of disc 22 except at the upper end of disc 22 which is at generally the same level as the upper edge 28 of cylindrical member 24. Because the upper edge 28 and the upper end of disc 22 are at the same level, the capsules/tablets or other objects 16 move under centrifugal force onto the upper edge 28. In the preferred practice of this invention upper edge 28 is of a width so that only a single line of objects is formed on the upper edge 28. In order to facilitate moving the objects away from the upper end of disc 22 and to keep them in a single line on the upper edge 28 of cylindrical member 24, cylindrical member 24 is rotated by motor 36 at a sufficient speed to achieve this function. Such speed would generally be far less than the high speed of rotation of disc 22.

As illustrated a guide wall 38 is mounted at the upper edge 28 of cylindrical member 24 and extends upwardly above edge 28. Guide wall 38 is mounted in any suitable manner so that it remains stationary or fixed while the feed hopper 20 is rotating. As illustrated guide wall 38 extends more than 360° having a pair of free ends 40,42 which are disposed opposite each other to create a discharge opening 44 at the discharge station of system 10. Free end 44 is secured to the inner side of upper edge 28 and then gradually extends across upper edge 28 until the main portion of wall 38 is disposed at the outer side of upper edge 28 with free end 40 extending away from edge 28. Free end 40 is, for example, tangential with respect to the outer side of edge 28. If desired wall 38 may be detachably mounted so that it can be replaced with other wall members to conform to the particular size of the objects 16 being handled.

In the preferred practice of this invention the width of upper edge 28 corresponds to the size of a single object 16 so that a single line of objects 16 is transported on the upper edge 28 which is particularly desirable when the objects comprise capsules/tablets which must be counted so that a predetermined number is deposited in each container. The invention, however, may be broadly practiced by having the width of upper edge 28 of a larger size to accommodate more than one object in side by side relationship rather than a single line of objects. Such practice of the invention could be utilized where the count is not as critical or where the count takes place by some means such as a level detector located at the containers to sense when the proper level of objects has been deposited in each container.

As a safeguard a level detector 46 is mounted in hopper 20 to sense when the level of objects on disc 22 is above or below a predetermined level. Detector 46 may be of any suitable known construction and would be shaped and angled to avoid damaging the objects. Detector 46 would inactivate conveyor 12 when the level of object 16 in hopper 20 exceed a predetermined level so that further objects are not deposited in hopper 20. Conveyor 12 would then again be reactivated when the objects 16 in hopper 20 falls below the predetermined level. Detector 46 may, for example, utilize a microswitch which is activated in accordance with the level of objects detected in hopper 20.

As illustrated, a delivery chute 48 is located at the opening 44 of the discharge station and is directed to deposit the objects 16 into any suitable container 50. Although container 50 is illustrated as being in box-like form, in the preferred practice of the invention the container would be a bottle. Where small containers, such as bottles, are used, a gap could be created in the line of objects fed down chute 48 to provide sufficient time for a filled bottle to be removed and an empty bottle disposed at the delivery end of chute 48. The gap could be created by a later described deflector 54 as actuated by controller 60.

Figure 2:
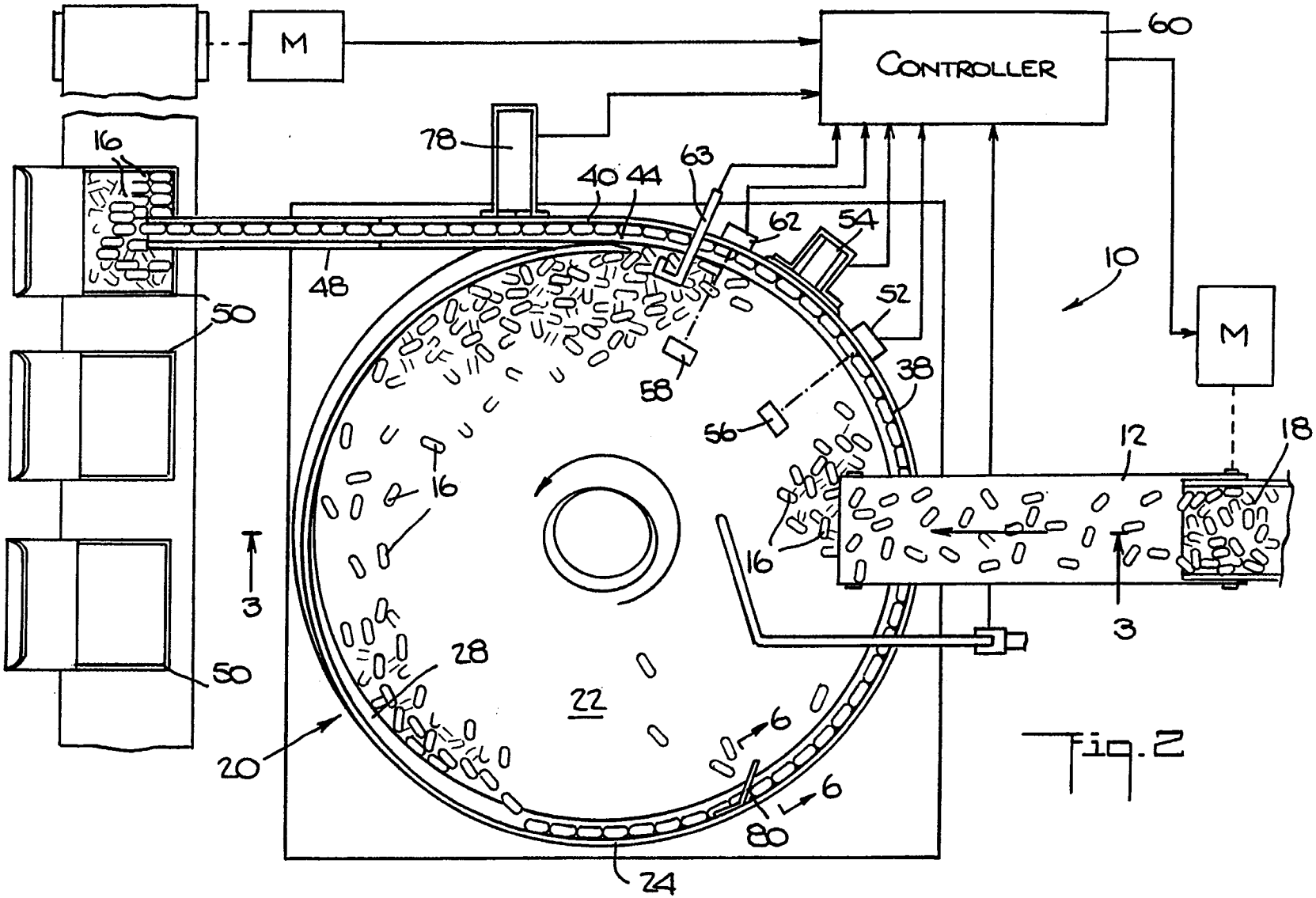
FIG. 2 is a top plan view of the system shown in FIG. 1.

A particularly advantageous feature of this invention is the utilization of delivery control means for shutting off the delivery of objects 16 to discharge opening 44 upon sensing some predetermined condition. The delivery control means is preferably a counter and in the preferred practice of this invention is a pair of counters which count the objects 16 moving on upper edge 28 immediately before passing into discharge opening 44. FIG. 2, for example, illustrates a first counter 52 which may be of any suitable construction such as an optical counter, but preferably is a laser counter as later described. A second counter 62 is located downstream from first counter 52. Second counter 62 is also preferably a laser counter.

Where laser counters 52,62 are used a beam of light would be directed toward a respective photo detector 56,58. More particularly, a non-contact laser diode in counters 52,62 generates a laser beam directed to a focusing lens which collimates a laser beam to a focal point of, for example, 0.000025 meter diameter. The light subsequently diverges and falls on a solid state photo detector 56,58 equipped with a high speed circuitry. When an object 16 blocks the laser beam the beam is considered interrupted. Consequently, the amount of light reaching the photo detector 56,58 falls below a preset full scale value providing a beam interrupt signal. The highest potential sensitivity may be reached when the object 16 interrupts the beam at its focal position. This characteristic enables contours of the capsules/tablets to be measured or detected if placed at the focal point. Such arrangement would compensate for the presence of dust and debris which usually degrades the performance of typical sensors. Such arrangement also compensates for a change in lighting conditions. Such an arrangement is capable of counting and delivering capsules/tablets at the rate, for example, of 100 per second and enables the tablets/capsules to be measured for any defect in size or shape. The tablets/capsules would be delivered to the window of the laser sensor. The profile of each tablet/capsule interrupts the laser beam focal point causing the photo detector 56,58 to send a signal to the programmable controller 60 to count each profile.

The use of two counters 52,62 is preferable to provide a double check on the accuracy of the count. The location of the counters 52,62 from each other may take into account the length of a line of objects 16 where each object is of predetermined length to assure that the objects are disposed in the proper orientation for passing through discharge opening 44. The counters can also be used to determine if objects are broken or damaged or if the objects are of the wrong shape where, for example, incorrect objects are deposited in the feed hopper. Such system is particularly desirable if, for example, a batch such as ten tablets/capsules is to be deposited in a bottle or container 50. Thus, for example, if counter 52 counts ten objects, counter 62 must also count ten objects or the system 10 is shut down by controller 60. After a proper count is reached, the laser counters are re-calibrated. It is preferred that each counter 52,62 and its photo detectors 56,58 be radially aligned with respect to the center of hopper 20 for best results.

If desired a further counter 78 may be located along discharge chute 48. Counter 78 may be of any suitable form, such as having the construction of counters 52,62.

As shown in FIG. 2 and indicated by the arrowheads, controller 60 is connected to all of the operating mechanisms in system 10 for assuring the coordinated control of the individual components which form system 10.

The details of controller 60 are not critical for the practice of this invention. Thus, any suitable known controller using, for example, a microprocessor could be used for controlling the actuation and the synchronization of the various components in system 10.

Figures 4, 5, 6:
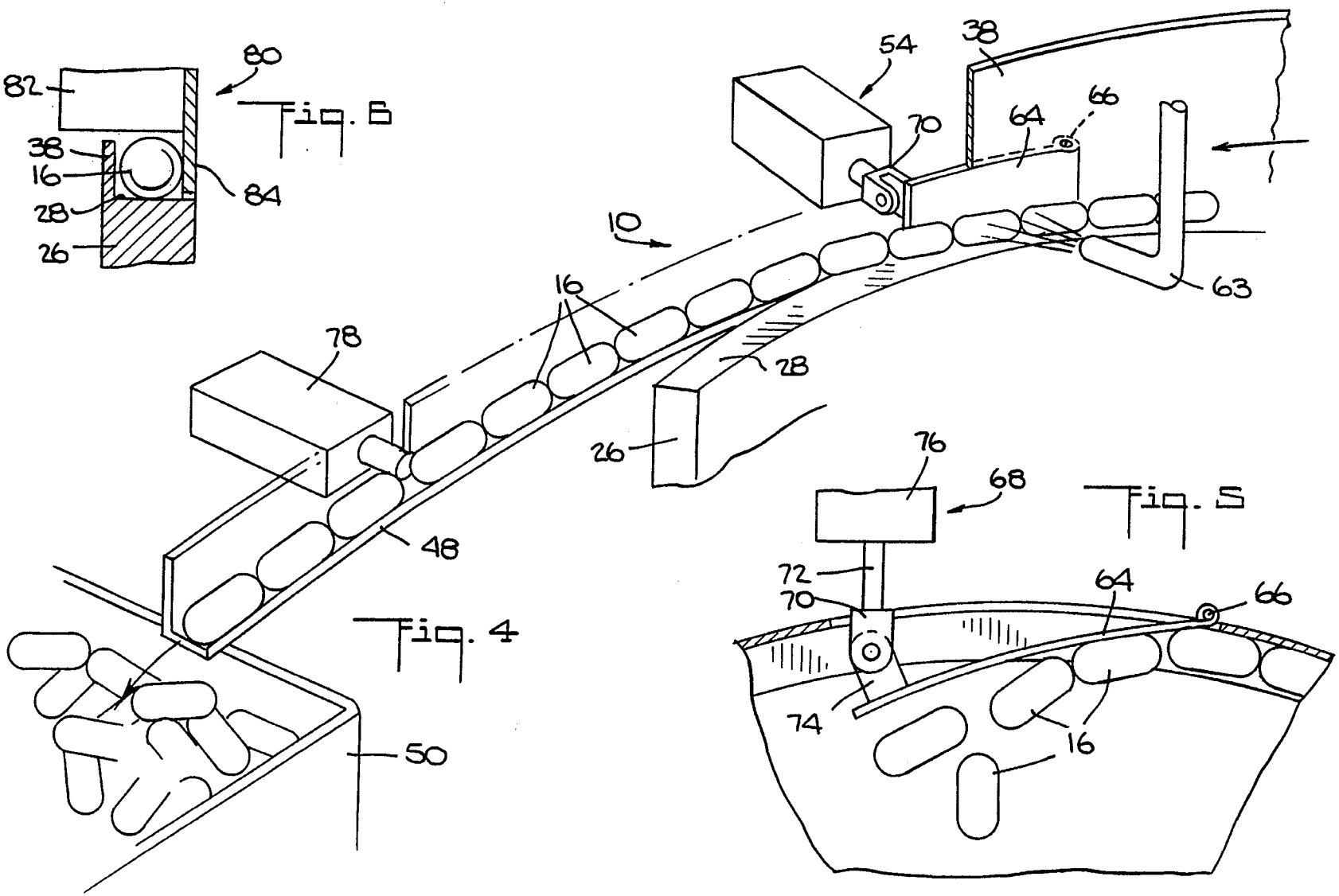
FIG. 4 is a perspective view partly in section showing the delivery station of the filling system shown in FIGS. 1–3.
FIG. 5 is a plan view partly in section illustrating a diverter in its phase of operation for diverting objects back into the feed hopper in the system of FIGS. 1–4.
FIG. 6 is a cross-sectional view in elevation taken through FIG. 2 along the line 6—6 showing a sensing member for assuring that the objects are of proper size for use in the filling system of this invention.

Another feature of system 10 is the inclusion of a deflector 54 for deflecting objects back into hopper 20. FIGS. 4–5, for example, illustrate one form of deflector 54. As shown therein deflector 54 includes a plate 64 hinged at pin 66 against wall 38 or wall 38 may include a recess or cutout for receiving plate 64 so as to form an uninterrupted surface when plate 64 is in its non-deflecting position as illustrated in FIG. 4. A piston cylinder assembly 68 is mounted outside of wall 38 with a U-shaped bracket or yoke 70 connected to the end of the piston 72. A flange 74 extends from plate 64 and is pivotally connected in bracket 70. When piston 72 is extended from cylinder 76 plate 64 is pivoted away from cylinder 76 as shown in FIG. 5 to deflect the line of objects 16 back into hopper 20. Deflector 54 would be actuated whenever it is desired to stop the flow of objects 16 from passing through discharge opening 44. Such flow would be stopped when, for example, time is required to dispose a further container at the end of chute 48.

Although FIGS. 4–5 illustrate a mechanical deflector 54 the invention may be practiced by using an air deflector. This would involve having a nozzle located in wall 38 through which a jet of air would be ejected when it is desired to actuate the deflector so that the jet of air would cause the line of objects 16 to be deflected into hopper 20. Where an air deflector is utilized the compressed air is allowed to flow through an orifice or nozzle. Once the proper count is reached by the counter 52, an automatic signal is sent to the electronic-pneumatic circuit of controller 60 to energize a miniature coil to open the path for the compressed air to direct the flow of the objects 16 back into hopper 20.

Deflector 54 is preferably located between counters 52 and 62 so that deflector 54 could begin deflecting object into hopper 20 once upstream counter 52 senses the predetermined count. In the preferred practice, particularly when an air jet deflector is used, deflector 54 is adjustably mounted so that it could be spaced from counter 52 by a distance corresponding to from 1 to 1½ times the length of an object. If desired, deflector 54 could be mounted upstream from counter 52 depending on the speed of the objects.

An air nozzle 63 may also be located immediately upstream from opening 44 to direct an air jet against the objects 16 and toward guide wall 38. This assures that the objects are directed out of the circular path and into discharge opening 44.

System 10 may also include an inner guide member 80 for maintaining the objects 16 in line against guide wall 38. The inner guide member may take any suitable form, such as an L-shaped bracket mounted to the top of guide wall 38. FIG. 6, for example, illustrates such a guide 80 to include a horizontal leg 82 mounted over guide wall 38 with a vertical leg 84 extending downwardly parallel to guide wall 38 at the inner end of upper surface 28 of cylindrical member 24. A passageway is thus created between guide wall 38 and legs 82 and 84. A further feature of the inner guide wall 80 is to act as a sensor to assure that the objects 16 are of proper size and orientation. Thus, for example, where the objects are tablets or capsules are of a form, such as triangular form, it is possible that one object may wedge between two other objects. This would be detected by inner guide 80 since the wedged group of objects would not pass through the passageway created by inner guide 80 and guide wall 38. Alternatively, depending on the manner in which the objects are wedged together, inner guide leg 84 might cause the wedging to be dislodged so that the objects again resume the proper single line orientation. Inner guide 80 could be at any suitable location. Preferably inner guide 80 should be located upstream from counters 52,62 and also located upstream from deflector 54 so that the sensing of an abnormal condition at inner guide 80 could be utilized to actuate deflector 54 so that further objects are prevented from being deposited in container 50.

The invention may be practiced by utilizing the inner guide 80 along spaced portions of or substantially the entire path of travel of the single line of objects 16 from the point that objects 16 first travel on upper edge 28 of cylindrical member 24 to the discharge opening 44. Where such inner guide 80 is provided as being of extended length a suitable opening should be provided to permit deflection of the objects back into hopper 20 at each location of deflector 54.

Figure 7:
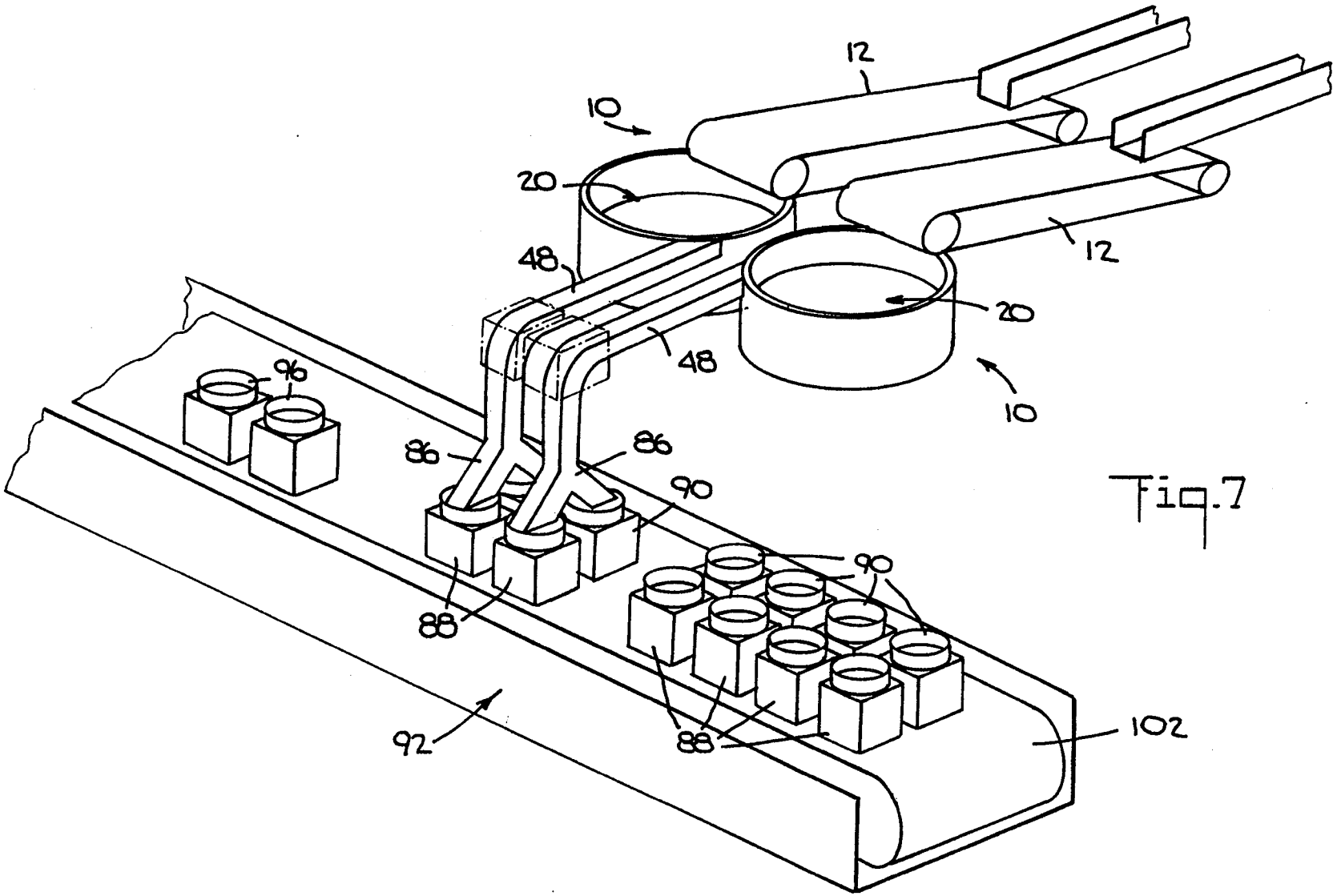
FIG. 7 is a perspective view of a modified form of filling system incorporating a dual filling arrangement in accordance with this invention.

System 10 as described in FIGS. 1–6 represents a basic automatic filling system for effectively filling objects such as capsules/tablets into a container such as a bottle. The system could be modified to increase the speed of filling by, for example, incorporating multiples of the system operating jointly in connection with a simultaneous supply of multiple containers. FIG. 7, for example, illustrates a dual arrangement which utilizes two systems 10 each of which would be substantially identical to system 10 as described in FIGS. 1–6 except for discharge portion of each system.

As shown in FIG. 7 each chute 48 leads to a V-shaped distributor 86 which is placed so as to enable the objects 16 to flow through either path of distributor 86 to be dispensed to a specific container 88,90 wherein two sets of such containers are disposed side by side forming a column of containers 88 and a second column of containers 90. The four containers being filled are located by any suitable indexing device at index station fill 92. The indexing device would transport a container from one column 88 into the indexing/fill station 92 in a time staggered manner with respect to the other column of containers 90. Thus, while one container is being filled the second container is being transported to the indexing/fill station 92. For the sake of simplicity of illustration FIG. 7 illustrates four such containers to be simultaneously at indexing/fill station 92.

It is to be understood that the arrangement of FIG. 7 which includes a distributor 86 for each system 10 and which includes feeding two columns of containers to a filling system 10 could be utilized even where a single filling system 10 is used. The use of a distributor, such as distributor 86, is not limited to a dual or multiple arrangement. There would be a period of time elapsed where the final count of the last object 16 and the resetting of the counter to 0. This same elapsed period allows the V-shaped distributor to reset the path so as to be switched to the other container. This period of time is estimated to be 3/1000 second.

The invention may be practiced where a dual arrangement is used with an indexing system to receive the containers initially fed in a single line. All of the containers could initially be transported by an input conveyor system. The indexing system could then move the containers in a perpendicular motion alternately in each direction away from the longitudinal centerline of the input conveyor by suitably disposed diverters so that the two columns of containers are formed on the conveyor. Thus, each feeding system 10 would receive two containers. As soon as the filling operation is completed the indexing system would dispense the containers back into a single line by suitably located diverters onto an output container.

The input conveyor could receive the containers cleaned and properly oriented in a single line in order to transport them to the indexing mechanism.

The invention could be practiced with the single line of filled containers being transported to a diverting station which diverts containers not properly filled. If both of the previously described counters sense that a container is properly filled, the properly filled containers could continue to be conveyed in a single line. If one or both counters do not sense the proper number of objects in a container, these improperly filled containers could be diverted to a separate line for further processing or disposal.

As can be appreciated the automatic filling system 10 consists of a dynamic transporting system capable of conveying delicate tablets and capsules. The system 10 may run continuously or intermittently. Continuous motion would be utilized to convey relatively high counts of tablets or capsules to the centrifugal feeding system. The system may run intermittently to run relatively low counts of tablets or capsules.

What is claimed is:

1. An automatic filling system for inserting objects into containers comprising a feed hopper, conveying means for conveying a plurality of the objects into said feed hopper, said feed hopper having a discharge station, a collection station for disposing the containers at said discharge station for receiving the objects in each container, said feed hopper including a flat inclined disc disposed for receiving the objects from said conveying means, means for rotating said flat inclined disc for causing the objects to move under centrifugal force toward the periphery of said disc, said feed hopper further including a cylindrical member having an annular wall disposed around said disc and having an upper edge located at generally the same elevation as the upper end of said disc whereby the objects moving toward said periphery of said disc are moved to said upper edge of said cylindrical member and are conveyed on said upper edge of said cylindrical member away from said upper end of said disc, said discharge station being located at said upper edge of said cylindrical member for depositing the objects in the containers at said collection station, and counter means in said feed hopper counting the number of objects being deposited in each container.

2. The system of claim 1 including means for rotating said cylindrical member to facilitate conveying the objects away from said upper end of said disc.

3. The system of claim 2 including a fixed guide wall disposed at said upper edge of said cylindrical member and extending above said upper edge, and said discharge station including a discharge opening at said fixed guide wall.

4. The system of claim 3 wherein said fixed guide wall extends more than 360° with two end portions disposed along side and spaced from each other to form said discharge opening.

5. The system of claim 3 wherein said counter means includes two counters spaced from each other.

6. The system of claim 5 wherein each of said counters is a laser counter.

7. The system of claim 6 wherein each of said laser counters includes a laser generator and a photo detector radially aligned with respect to the center of said hopper.

8. The system of claim 3 including a controller for controlling the actuation of the rotation of said disc and of said cylindrical member and the actuation of said counter means.

9. The system of claim 3 including first deflector means for deflecting objects in excess of a predetermined number back into said feed hopper, and second deflector means for directing the predetermined number of objects to said discharge opening.

10. The system of claim 9 including level indicating means for controlling the actuation of said conveying means.

11. The system of claim 10 including an inner guide assembly for maintaining the objects against said fixed guide wall.

12. The system of claim 11 wherein said inner guide assembly further comprises sensor means for sensing the size and orientation of the objects.

13. The system of claim 11 including a discharge chute located at said discharge station for directing the objects into the containers.

14. The system of claim 13 including a V-shaped distributor at the end of said chute for directing the objects alternately into one of two containers.

15. The system of claim 14, in combination therewith, there being a plurality of such systems for simultaneously depositing objects into a plurality of containers at said collection station.

16. The combination of claim 15, in further combination therewith, wherein said objects are capsules/tablets and said containers are bottles.

17. An automatic filling system comprising a feed hopper for containing a plurality of objects, a discharge station, transport means for transporting the objects in a single line from said hopper to said discharge station, counter means in said feed hopper for counting the objects being transported to said discharge station, and said counter means directing a beam toward the line of objects, said counter means including a laser counter for directing a laser beam toward a photodetector.

18. The system of claim 17 wherein said counter means detects if the objects are properly oriented and of the proper shape and size and detects if the objects are unbroken and undamaged.

19. The system of claim 17 wherein said counter means includes two of said laser counters and photo detectors, and each of said laser counters and its said photo detector being radially aligned with respect to the center of said feed hopper.

20. The system of claim 19 including deflecting means for deflecting objects in excess of a predetermined number back into said feed hopper when a predetermined count is detected by said counter means.

21. The system of claim 20 including second deflecting means for directing the predetermined number objects to said discharge station.

* * * * *